US006153023A

United States Patent [19]

Rokutanda et al.

[11] Patent Number: 6,153,023

[45] Date of Patent: Nov. 28, 2000

[54] HARDENED METAL PRODUCT PRODUCED BY SHOT PEENING WITH SHOT HAVING HIGH HARDNESS

[75] Inventors: Hitoshi Rokutanda; Toru Takahashi; Junkou Kurosaki; Toshiroh Ito, all of Toyokawa, Japan

[73] Assignees: Sintokogio, Ltd.; Sintobrator, Ltd., both of Japan

[21] Appl. No.: 09/193,965

[22] Filed: Nov. 18, 1998

Related U.S. Application Data

[62] Division of application No. 08/890,774, Jul. 11, 1997, Pat. No. 5,916,383.

[30] Foreign Application Priority Data

Jul. 12, 1996 [JP] Japan ..... 8-202932

[51] Int. Cl.[7] ..... C21D 1/06

[52] U.S. Cl. ..... 148/316; 148/317; 148/318; 148/319; 148/328; 148/405

[58] Field of Search ..... 148/316–319, 148/328, 405

[56] References Cited

U.S. PATENT DOCUMENTS

| | | | |
|---|---|---|---|
| 4,379,745 | 4/1983 | Polizzotti et al. | 208/132 |
| 5,019,182 | 5/1991 | Arimi | 148/12.1 |
| 5,477,976 | 12/1995 | Suzuki et al. | 216/109 |
| 5,595,613 | 1/1997 | Hatano et al. | 148/319 |

FOREIGN PATENT DOCUMENTS

| | | | |
|---|---|---|---|
| 59-227365 | 12/1984 | Japan | B24C 1/10 |
| 62-253723 | 11/1987 | Japan | C21D 8/00 |
| 4-201128 | 7/1992 | Japan | B23P 15/14 |
| 405195070A | 8/1993 | Japan . | |

*Primary Examiner*—Deborah Yee
*Attorney, Agent, or Firm*—Limbach & Limbach, L.L.P.

[57] ABSTRACT

A method for shot peening a hard metal product that has a hardened surface. The method includes projecting shot on the hardened surface of the hard metal product. The ratio of the Vickers hardness of the shot to that of the hardened surface is 0.8–1.6, and the diameter of the shot is 30–250 $\mu$.

2 Claims, 3 Drawing Sheets

Test Results

| | Peening Conditions | | Products | | After Shot Peening | | |
|---|---|---|---|---|---|---|---|
| Test | Shot Type | Shot Speec (m/s) | Material | Surface Hardness (HV) | Surface Hardness (HV) | Stress (MPa) * | Rate of Fatigue Life |
| A | ① | 25 | SKD | 1200 | 1460 | 2420 | 280 |
| B | ② | 25 | SKD | 1200 | 1510 | 2800 | 330 |
| C | ③ | 25 | SKD | 1200 | 1530 | 2850 | 320 |
| D | ④ | 25 | SKD | 1200 | 1550 | 2900 | 250 |
| E | ⑤ | 25 | SKD | 1400 | 1690 | 3100 | 360 |
| F | ⑥ | 25 | SKD | 1200 | 1450 | 2750 | 270 |
| G | ⑦ | 25 | SKD | 1400 | 1630 | 2550 | 240 |
| H | ⑧ | 75 | SKD | 1200 | 1330 | 1380 | 95 |
| I | ⑨ | 75 | SKD | 1200 | 1350 | 1450 | 100 |
| J | ⑩ | 75 | SKD | 1200 | 1270 | 1250 | 85 |
| K | ⑤ | 25 | SKD | 900 | 1250 | 2150 | 220 |
| L | ⑦ | 25 | SUJ | 900 | 1230 | 2360 | --- |
| M | ⑦ | 25 | SWOSC | 950 | 1300 | 2450 | --- |
| N | ⑦ | 25 | SCM | 850 | 1220 | 2250 | --- |
| O | ⑦ | 25 | SKS | 800 | 1170 | 2120 | --- |
| P | ⑦ | 25 | SKH | 900 | 1240 | 2340 | --- |
| Q | ② | 35 | SKD | 1200 | 1550 | 3200 | 330 |
| R | ② | 50 | SKD | 1200 | 1570 | 3100 | 250 |
| S | ② | 15 | SKD | 1200 | 1440 | 2480 | 290 |

* Stress means the maximum residual compressive stress.

Fig. 2

Properties of Shot

| Shot Type | Specific Gravity | Hardness (HV) | Mean Dia. (μ) |
|---|---|---|---|
| ① | 14.7 | 1400 | 35 |
| ② | 14.7 | 1400 | 100 |
| ③ | 14.7 | 1400 | 200 |
| ④ | 14.7 | 1400 | 250 |
| ⑤ | 11.8 | 1950 | 100 |
| ⑥ | 19.0 | 1150 | 100 |
| ⑦ | 18.8 | 1000 | 100 |
| ⑧ | 7.8 | 800 | 200 |
| ⑨ | 7.8 | 800 | 350 |
| ⑩ | 7.8 | 550 | 350 |

Shot type 8, 9, and 10 are conventional shot.

Fig. 3

HARDENED METAL PRODUCT PRODUCED BY SHOT PEENING WITH SHOT HAVING HIGH HARDNESS

This is a divisional of application Ser. No. 08/890,774, filed Jul. 11, 1997, now U.S. Pat. No. 5,916,383.

FIELD OF THE INVENTION

This invention relates to a method of shot peening for hard metal products and such hard metal products treated by shot peening.

DESCRIPTION OF THE PRIOR ART

To enhance the mechanical properties and fatigue life of metal material, shot peening has been used, wherein shot, for example, made of steel, is projected on the metal material. As is well known, shot peening is used for steels for gears, springs, etc.

For example, Japanese Patent A-62-253723 discloses applying heat treatments of hardening by carburizing and of tempering, to a gear element made of a steel alloy, and then shot peening it by using steel shot of 46–56 Hrc (460–620 HV) hardness. The patent also discloses that the maximum residual stress in the gear element is near its outermost surface (i.e., 10–20 $\mu$m from the surface of the element) if the size or diameter of the shot is small, that is, if it ranges from 50–200$\mu$ (0.05–0.2 mm).

Japanese Patent A-4-201128 discloses shot peening wherein a steel alloy which is carburized or carbonitrided is treated so that a hardened layer which has an effective hardness (550 HV) and a thickness of more than 0.7 mm is formed in its surface, and wherein the alloy is then subjected to shot peening by steel shot having a diameter of less than 300$\mu$ and a hardness of 700–850 HV.

However, in the conventional shot peening as in the foregoing patents, the hardness of the shot is 400–850 HV. Judging from this hardness, the hardness of material to be processed is equal to or less than it, because the residual compressive stress in the material is due to its very small plastic deformation produced by the projected shot that has a hardness equal to or greater than that of the material to be processed.

Thus the compressive stress produced on the surface of the material is low. Further, since the point where the residual compressive stress is maximum in the material is inside the outermost surface, the strength and fatigue life are not so enhanced.

Further, since the material tends to break first at its surface layer due to the stresses acting on it, preferably the maximum residual compressive stress is in the outermost surface of the material. In the prior art, since the maximum residual compressive stress is inside the outermost surface of a hard metal product, the surface layer of the material is removed by machining it (for example, Japanese Patent A-59-227365). This treatment costs a lot and is time-consuming.

Further, when the surface of a metal material is treated such that it is hardened, the resulting material differs from a metal product that is uniformly hard. The treated material is comprised of a fragile, composite layer produced at the outermost surface and a diffusion layer in which the inner elements are diffused. Accordingly, if conventional steel shot, which is normally used for a surface that is not so hard, is used for shot peening the treated material, no layer in which a very small plastic deformation is produced is formed. Further, if a lot of kinetic energy is applied to the surface layer, the surface of the material becomes rough and the life of the shot is shortened.

Thus a suitable method of shot peening has not been established where a metal product to be processed has a hard surface that approximately equals the conventional hard shot. Accordingly, a method of shot peening for a hard metal product that has a hard surface is now desired.

Further, neither where the maximum residual compressive stress is produced in a hard metal product that has been subjected to shot peening by shot that has a hardness greater than that of the surface of the hard metal product to be processed, nor what the magnitude of the stress is, has been found.

This invention will resolve the drawbacks of the conventional shot peening. It aims to provide a method of shot peening for a hard metal product that was treated so that its surface becomes hard, especially a method of shot peening for a hard metal product wherein the maximum residual compressive stress is produced in the outermost surface of the hard metal product, and wherein the stresses becomes great.

SUMMARY OF THE INVENTION

To the above end, this method of shot peening for a hard metal product includes projecting shot on the surface of a hard metal product, which surface was treated to become hard. The ratio of the Vickers hardness of the shot to that of the hard metal product to be treated is 0.8–1.6, and the diameter of the shot is 30–250$\mu$.

According to the present invention, when shot is used which has a Vickers hardness of 0.8–1.6 times that of the surface of a hard metal product, and the size or diameter of which shot is 30–250$\mu$, the surface subjected to the shot peening does not become rough. Further, since a very small plastic deformation is produced at the outermost surface of the product, the maximum compressive stress is produced there.

Further, since a composite or a diffusion layer of the hard metal product that is caused by the surface-hardening treatment is subjected to a very small plastic deformation or removed by the hard shot, the best shot peening is carried out without surface roughness.

In this invention hard metal product to which shot peening has not been applied means a product that has a surface of a hardness of 800–2000 HV. Such a hard metal under JIS (Japanese Industrial Standards) is a steel alloy based on a SKD or SKH steel, or other steels, for a metal mold or a tool that resists impulses, abrasions, and deformations. However, material for the hard metal product is not limited to these steel alloys. For example, it may be a metal based on Ti, Ni, or Al that has been subjected to heat treatment.

Especially if the hard metal product is a steel alloy for a metal mold, a metal mold made of it is a good application of the present invention, because a metal mold is subject to stresses and wear at its outermost surface.

Further, when the hard metal product is a steel alloy for a tool, a tool made of it is also a good application of the present invention, because a tool is subjected to stresses, heat, and wear at its outermost surface.

In this invention the term "surface-hardening treatment" includes a heat treatment such as carburizing, nitriding, and boriding, but it is not limited to a heat treatment. Carburizing includes vacuum carburizing. Nitriding includes ionitriding and soft-nitriding. Boriding includes any method of boriding, for example, by powder, molten salt, and gas.

When the surface of a metal is to be hardened by carburizing, one of a hardness of 800–1200 HV is suitable for this invention. If the hardness of the surface is lower than 800 HV, shot peening with normal steel shot cannot be performed. When the metal surface is to be hardened by nitriding, one of a hardness of 850–2000 HV is suitable for this invention. When the metal surface is to be hardened by boriding, one of a hardness of 1200–1800 HV is suitable for this invention.

A surface-hardening treatment includes any of those carried out by induction hardening, laser hardening, and other methods, if sufficient hardness is obtained by them.

The reason why the maximum residual stress should be produced at the outermost surface of a surface-hardened metal product is that it eliminates post-treatment of the products, and that the residual stress effectively works.

In this invention the term "the outermost surface" means the surface of a metal product, and it ranges from zero to about 4$\mu$ from the outer (or inner) surface of the product. When residual stresses are measured by using the CrK$\alpha$ characteristics of an X-ray diffraction stress measuring device, it is found that the maximum residual stress is produced in the surface of the product. The value of the outermost surface is one that is determined by an effective transmission depth of an X-ray.

In this invention the reason why the diameter of the shot is 30–250$\mu$ is that excessive surface roughness would cause micro-cracks in the surface of a product, and thus notch sensibility would be increased, thereby shortening the fatigue life of the product. Thus it becomes unsuitable as a product that must have a long fatigue life.

Preferably the shape of the shot is spherical, but it may be other shapes that are close to a sphere, or cylindrical or cubic. These types of shot are normally used. Accordingly, such shot having a 30–250$\mu$ diameter is suitable.

According to the present invention, the fatigue life and mechanical properties of a hard metal product having a surface that is hardened by a surface-hardening treatment are enhanced. Further, the fatigue life of a metal mold, tool, etc. made of this product that is subjected to shot peening of the present invention is enhanced. Further, since the maximum residual stress is produced in the outermost surface of the product, the fatigue life of a hard metal product is also enhanced due to this, and no post-treatment to the product is necessary.

BRIEF DESCRIPTION OF THE DRAWINGS

FIG. 2 is a table showing the results of tests carried out by conventional shot peening and shot peening of the present invention.

FIG. 3 is a table showing the properties of shot used for the tests.

DESCRIPTION OF THE PREFERRED EMBODIMENT

Figure 1:
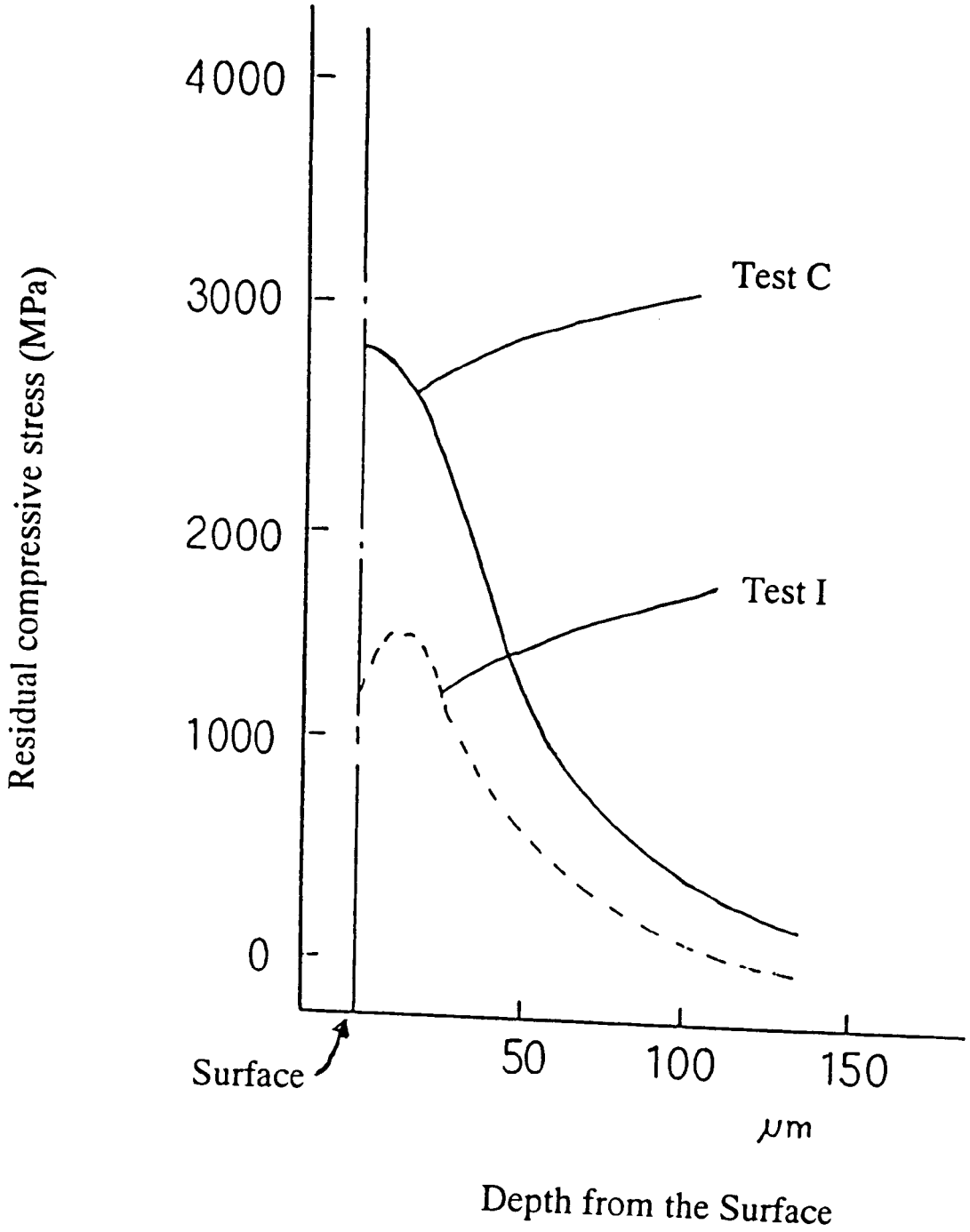
FIG. 1 is a graph of the distribution of residual compressive stresses in a hard metal material subjected to conventional shot peening and shot peening of the present invention.

The preferred embodiment of the present invention will now be explained. Hardening and tempering were applied to two metal molds (made of SKD 61 steel), which are used for hot forging. They were then ionitrided, so that their surfaces had a 1200 HV hardness. Shot peening with steel shot having 800 HV hardness and 75 m/sec speed was applied to one of the metal molds (Test I in FIGS. 1 and 2, a conventional method of shot peening). Shot peening with hard metal alloy shot (the main component of it is WC-Co) having 1400 HV hardness and 25 m/sec speed was applied to the other of the metal molds (Test C in FIGS. 1 and 2, a method of shot peening of the present invention).

As a result of Test C with the low hardness shot, the surface of the mold did not become rough, and the texture of the surface was the same before and after the shot peening treatment. As a result of Test I with the high hardness shot, the surface of the mold had a fine satin-like texture, and thus the surface had only a minor change before and after the shot peening treatment. The fatigue lives of the two molds were examined by repeatedly using them for hot forging. The mold of Test C had a life 4.1 times longer than that of the mold of Test I.

Further, residual stresses in the surface of the mold of Test C were measured. It was found that the maximum residual compressive stress was produced in the surface (the outermost surface) of the mold (Test C in FIG. 1).

If the maximum residual compressive stress is in the outermost surface as above, post-treatment by machining the mold is unnecessary, and the life of it is extremely lengthened.

Similarly, a surface-hardening treatment such as carburizing, nitriding, or boriding was applied to metal products (molds). Shot peening was then applied to them under various conditions. After the shot peening treatment, their hardness, residual compressive stresses, and ratio of the number of predetermined stresses repeatedly applied to the test product until it reached failure (ratio of the fatigue life), were measured. The ratio of the fatigue life of one metal product was obtained by comparing the number of repeated stresses of the metal product with that of the metal product of Test I (reference product; that is, the rate is 100). In FIG. 2, the shot type, shot speed (m/s), material, and surface hardness, of each hard metal product to be subjected to shot peening, and the surface hardness, the maximum residual compressive stress, and rate of its fatigue life after being treated by shot peening, are shown. The details of the shot type of FIG. 2 are shown in FIG. 3.

As a result of the tests, the following was found:

From Tests H, I, and J (conventional methods of shot peening), the hardness of the conventional shot was low; the rate of increase in the hardness of the hard metal products after the treatment of shot peening was low; and the maximum residual compressive stress was low.

This invention provides hard metal with a high hardness, a long life, and a high residual compressive stress, by selecting a suitable hardness and size of shot.

When the diameter of shot is less than 35$\mu$, the rate of increase in the hardness, residual compressive stress, and fatigue life, all tend to be low (Test D). This is because the surface roughness increases after the shot peening treatment. Accordingly, we consider that in this invention the diameter of the shot should be 250$\mu$ at the maximum.

When the hardness of the shot is lower than that of the hard metal product, the maximum residual compressive stress tends to become low, resulting in a low rate of increase in the fatigue life (Test G).

When the hardness of the shot is much higher than that of the hard metal product, the maximum residual compressive stress tends to become low, resulting in a low rate of increase in the fatigue life (Test K).

In Tests L, M, N, O, and P, since the material of each hard metal product is not an SKD steel, simply comparing their fatigue life rates with those of other tests may be difficult. However, the hardness of each product was greatly enhanced after the shot peening treatment, and its strength was highly enhanced.

Further, the lives of the metal molds of Tests B and I were compared by repeatedly producing aluminum die castings. As a result, the hard metal product of the invention (Test B) could have produced a number of die castings that is 3.8 times that produced by the hard metal product treated by conventional shot peening. Thus the former product has a life 3.8 times that of the latter.

Further, in the embodiment, when the specific gravity of the shot is 11–20, it is higher than that of the conventional shot. Thus great energy is obtained by shot collision even if the speed of the shot is low, thereby producing the maximum residual compressive stress in the outermost surface of the hard metal product. This corresponds to shot peening wherein hard shot is used.

Further, in the embodiment, a shot speed of 10–45 m/sec is the best (Test Q), because if it is more than 50 m/sec (Test R), the surface becomes rough, causing no good effect on the fatigue life, while the life of the shot tends to be shortened. Further, if the speed of shot is less than 15 m/sec (Test S), the fatigue life of the hard metal product tends to be shortened, because sufficient energy is not obtained by the shot collision.

What we claim is:

1. A hardened metal product wherein a maximum residual compressive stress has been produced in an outermost surface of said hardened metal product by hardening the outermost surface to produce a hardened outermost surface having a hardness of 800–1200 HV and the shot peening the hardened outermost surface with shot having a Vickers hardness equal to or greater than 1000 HV to produce a twice-hardened outermost surface of said hardened metal product, said twice-hardened outermost surface having a hardness at least 230 HV greater than that of the hardened outermost surface.

2. A hard metal product wherein a maximum residual compressive stress has been produced in a surface of the hard metal product by performing heat treatment on the surface to cause the surface to have a first hardness of 800–2000 HV, and then projecting shot on said surface to cause said surface of the hard metal product to be a twice-hardened surface, wherein the Vickers hardness of the shot is greater than the first hardness by 200–500 HV, and the shot has Vickers hardness equal to or greater than 1000 HV, said twice-hardened surface of the hard metal product having a hardness at least 230 HV greater than the first hardness.

* * * * *